United States Patent [19]

Biszantz

[11] 4,208,148

[45] Jun. 17, 1980

[54] WEDGE FOR WOODEN HANDLED TOOL

[75] Inventor: Donald W. Biszantz, Loveland, Ohio

[73] Assignee: Easco Tools, Inc., Glen Burnie, Md.

[21] Appl. No.: 9,754

[22] Filed: Feb. 5, 1979

[51] Int. Cl.[2] ..... B25G 3/28

[52] U.S. Cl. ..... 403/251; 145/29 R; 85/21; 403/409

[58] Field of Search ..... 403/277, 249, 250, 251, 403/369, 409, 374; 85/11, 21; 145/2 R, 29 R; 113/116 H; 29/432, 525

[56] References Cited

U.S. PATENT DOCUMENTS

| | | | |
|---|---|---|---|
| 150,385 | 4/1874 | Yerkes | 403/277 |
| 546,269 | 9/1895 | Coutant | 85/21 |
| 1,931,234 | 10/1933 | Moseley | 403/277 |
| 2,155,893 | 4/1939 | Fulton | 85/21 X |
| 2,231,068 | 2/1941 | Harrington . | |

FOREIGN PATENT DOCUMENTS

| | | | |
|---|---|---|---|
| 259188 | 6/1949 | Switzerland | 403/251 |
| 246704 | 2/1926 | United Kingdom | 403/251 |
| 268400 | 3/1927 | United Kingdom | 85/11 |

*Primary Examiner*—Andrew V. Kundrat
*Attorney, Agent, or Firm*—Wood, Herron & Evans

[57] ABSTRACT

A wedge for securing a wooden handle to the head of a tool, the wedge having serrated tapered surfaces and serrated tapered edges and being bent into a U-shape. The wedge has a bight portion laying adjacent the end of the oval-shaped eye of the tool, and has arms lying parallel to the major axis of the oval-shaped eye of the tool.

6 Claims, 5 Drawing Figures

WEDGE FOR WOODEN HANDLED TOOL

This invention relates to a wedge for wooden handled tools such as axes, sledges, mauls, hammers and the like, and the invention relates to a method of securing a handle to the head of such a tool.

In the manufacturing of wooden handled tools, it has been the practice to form a head with an eye passing therethrough, the eye being generally oval-shaped with differing cross-sectional configurations depending upon the tool to which the handle is applied. The eye is also tapered in such a way that when a handle is inserted and has its end portion expanded against the walls of the eye, the taper, coupled with the expansion of the end of the handle, provides a secure mounting of the head to the handle.

The expansion of the end of the handle with respect to the eye in the head has been accomplished in differing ways, but almost invariably some type of metallic wedge has been employed. One common technique involves the sawing of a slot in the end of the handle. The end of the handle is driven into the head with the end surface being flush with the surface of the head. Then a wooden wedge is driven into the slot to provide a filler for the slot and to provide some wedging force. Then a metallic wedge is driven into the end of the handle in approximately the center of the eye, the wedge being generally flat and lying along the major axis of the oval-shaped eye.

Another more recently developed method of securing a handle to the head of a tool is to secure it by an epoxy cement. The epoxy tends to secure the head to the handle with a greater degree of reliability than the conventional securing methods described above, but even epoxy-secured heads have flown off their handles as, for example, when they have overstruck an object. Further, the epoxy-secured head has the disadvantage of being difficult, if not impossible, to replace if the handle is broken.

It is, of course, important to find the most secure means for attaching the handle to the head of such a tool. Not only is it a nuisance to have the handle continually sliding off the tool, but additionally there is a danger present in the possibility of the handle striking another person, and this danger, with injuries resulting from flying heads, has resulted in multiple lawsuits against the manufacturers of wooden handled tools.

An objective of the present invention has been to provide a more secure method for attaching a head to a handle, and particularly it has been an objective of the invention to provide an improved wedge which, when driven into the end of the handle, provides a greatly improved securing force.

The objectives are achieved by providing a wedge which is initially flat, having stepped and tapered surfaces on each side as well as stepped and tapered edges. The wedge is bent into a U-shape having a bight portion and arms. The wedge is driven into the end of a handle which has first been driven into the eye of its head, the wedge being oriented so that the bight portion of the wedge lies adjacent the end of the oval-shaped eye and the arms lie generally parallel to the major axis of the oval-shaped eye and adjacent to the interface between the handle and the surface of the eye.

Surprisingly, this wedge and its position in the handle provides at least approximately twice the securing force of handle-to-head as does a wedge of two-thirds the volume of metal but of conventional flat configuration. The exact reason for the greater resistance to pull off is not known, although it is believed that the U-shaped configuration permits the wedging forces to be applied more directly to the interface between the handle end and head.

The objectives of the present invention will become more readily apparent from the following detailed description taken in conjunction with the accompanying drawings in which.

Figure 1:
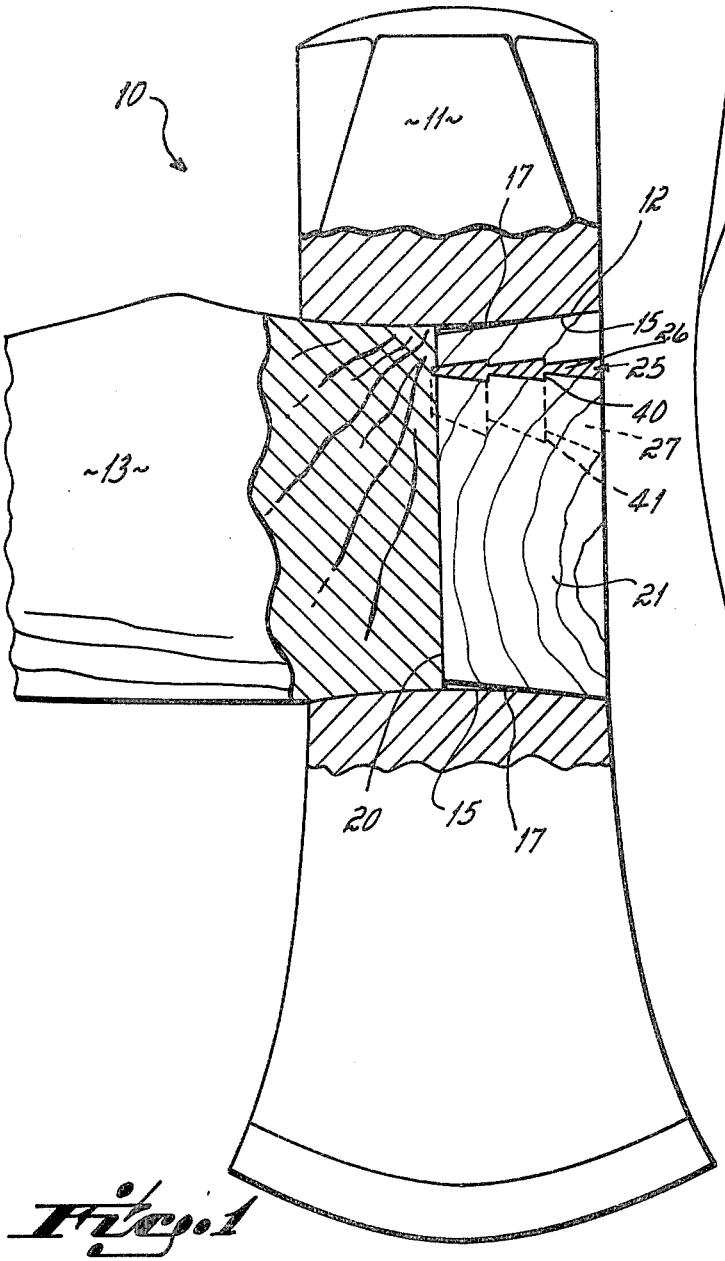
FIG. 1 is a fragmentary elevational view partly in section of a wooden handled tool with the wedge of the present invention applied.
Figure 2:
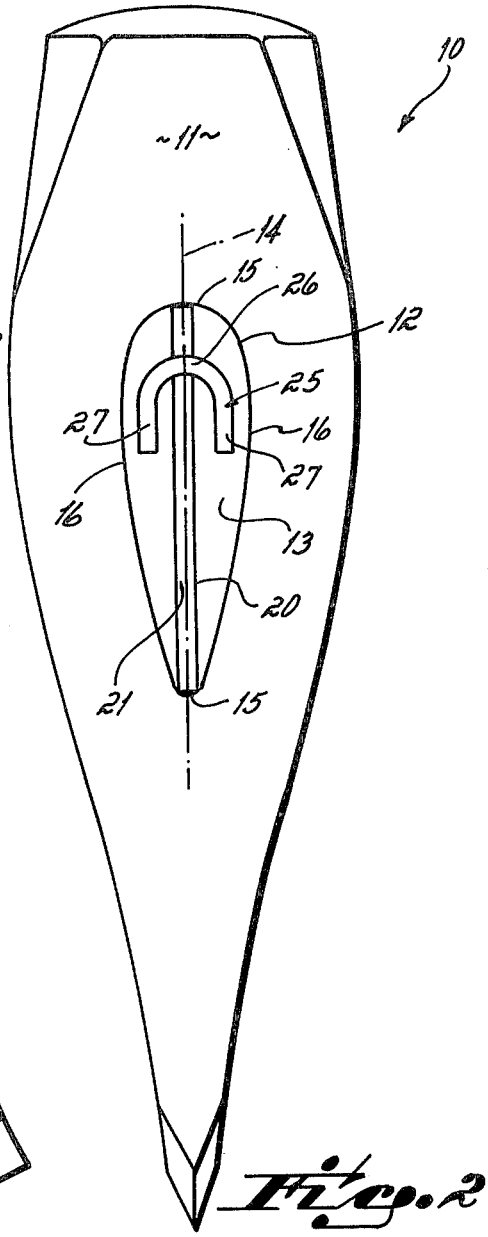
FIG. 2 is an end elevational view of the tool of FIG. 1.

Referring to FIGS. 1 and 2, the wooden handled tool illustrated is a maul 10. While a maul is illustrated, it is to be understood that the invention is equally applicable to other types of wooden handled striking tools such as all different types of hammers, hatchets, sledges, mattocks, picks and the like. The maul has a head 11 through which an eye 12 is formed. A wooden handle 13 is securely wedged in the eye 12.

As seen in the elevational view of FIG. 2, the eye 12 is generally oval-shaped and has a major axis 14, end walls 15 and side walls 16 generally parallel to the major axis. The walls are tapered as shown at 17 in FIG. 1 so that when a handle 13 is applied to the head 11 and wedged, the end of the handle flares outwardly and is tightly secured by the taper to the head.

The handle 13, in the illustrated embodiment, has a slot 20 which has been filled by a wooden wedge 21. A U-shaped wedge 25 of the present invention has been driven in the end of the handle as best shown in FIG. 2. It can be seen from FIG. 2 that the wedge has a bight portion 26 which lies adjacent to the end wall 15. The wedge has two arms 27 which lie adjacent the side walls 16 of the eye and are generally parallel to the major axis 14 of the oval-shaped eye.

It should be understood that the wedge of the present invention can be used with a plain ax handle which has not been previously slotted and filled with a wooden wedge.

Figure 3:
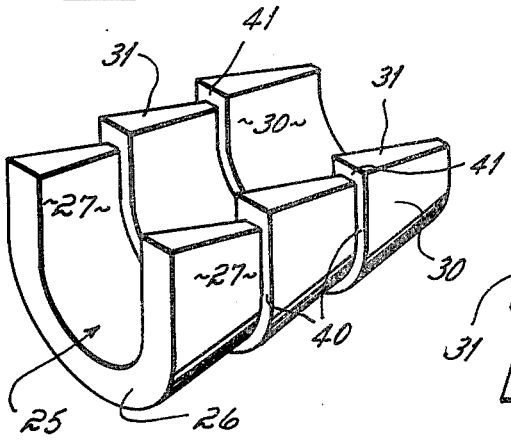
FIG. 3 is a perspective view of the wedge.
Figure 4:
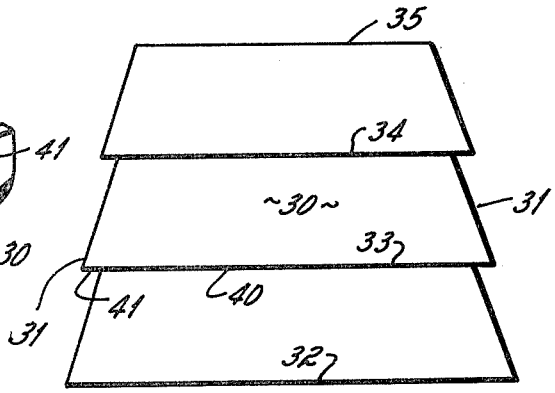
FIG. 4 is a side elevational view of the wedge before it has been bent into a U-shape.
Figure 5:
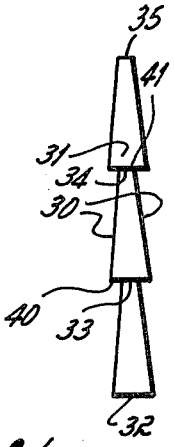
FIG. 5 is an end elevational view of the wedge before being bent into a U-shape.

The structure of the wedge is best illustrated in FIGS. 3–5. The wedge is formed from a straight blank shown in FIGS. 4 and 5. Each blank has a pair of opposed tapered and serrated surfaces 30 and opposed serrated tapered edges 31. The wedge in the condition of FIGS. 4 and 5 might be considered to be composed of three trapezoids having gradually diminishing bases 32, 33, 34, 35 from the outer end 32 to the inner end 35. In other words, in a large wedge of one and one-eighth inches dimension from outer edge 32 to inner edge 35, each base is one-eighth inch shorter than the base of the adjacent trapezoid going from outer to inner end of the wedge. The cross-sectional or thickness configuration of the wedge is the same for each of the three trapezoids. In the illustrated configuration, each trapezoid is three-eighths inch in height and the inclined edges of each trapezoid taper inwardly by five-thirty-seconds inch. The wedge is bent into the configuration shown in FIG. 3 on a three-sixteenths inch radius.

The invention contemplates providing smaller wedges for smaller tools, that is, wedges which are one inch and three-fourths inch high, respectively. Such wedges have overall configurations similar to those described above.

The handle is attached to the head of the tool in the following manner: in the illustrated form, the handle is first formed with a slot 20 in its end and is driven into the eye of the tool head as shown in FIGS. 1 and 2. A wooden wedge 21 is driven into the slot to act as a filler for the wood which was removed when the slot was formed. The wedge of FIG. 3 is driven into the end of the handle in the position illustrated in FIG. 2 with the bight portion 26 lying adjacent to the end of the eye 12 and with the arms 27 of the wedge lying adjacent to the side walls of the eye, the arms running parallel to the major axis 14 of the oval-shaped eye. After the wedge has been driven into the handle, the wood will tend to flow against the shoulders 40 and 41 formed by the serrated surfaces 30 and edges 31, respectively, of the wedge, thereby securing the wedge against inadvertently slipping out of the end of the handle. The volume of wood which is displaced by the wedge flows outwardly in all directions toward the walls of the eye 12 of the tool, thereby causing the handle to compress against the tapered walls 17 of the eye 12 to secure the handle in the head of the tool.

As indicated above, it is not known precisely why the U-shaped configuration of the wedge imparts such a high resistance to pull off. It is possible that the close adjacency of the wedge walls to the tapered walls of the eye provides a greater compression force of the wood handle against the walls of the eye. Further, there is a doubling of the thickness of the wedge across the transverse dimension of the eye by virtue of the bending of the wedge upon itself into a U-shape. Possibly that excess metal in that particular area contributes to the greater resistance to pull off.

Having described my invention, I claim:

1. A wedge for securing a handle to a head to form a wooden handled tool, comprising:

a metal blank formed as a plurality of similar trapezoids mounted one on top of the other, each trapezoid having a tapering thickness to provide a blank stepped on both faces and on its edges, said blank being bent in a U-shape about a line perpendicular to the bases of said trapezoids.

2. A wedge as in claim 1 in which the length of the bases of said trapezoids diminish from one end to the other of said wedge.

3. The method of securing a handle to the head of a wooden handled tool comprising the steps of:

forming a metallic wedge blank having stepped tapered side surfaces and stepped tapered edges, bending said blank into a U-shape, fitting a wooden handle into the eye of a tool head, said eye being generally oval-shaped, driving said wedge into the end of said handle with the bight portion of said U-shape located adjacent to one end of said oval-shaped eye.

4. The method as in claim 3 further comprising:

first forming a slot in the end of said handle, driving a wooden wedge into said slot, said metallic wedge having arms which are parallel to said wooden wedge.

5. In a wooden handled tool having a head, an oval-shaped eye and a handle fitted into the oval-shaped eye, a metallic wedge comprising:

a pair of opposed serrated tapered surfaces, a pair of opposed tapered serrated edges, said metal wedge being bent into a U-shape and having a bight portion disposed adjacent to one end of the oval-shaped eye and having arms extending parallel to the major axis of said oval-shaped eye.

6. In a wooden handled tool having a head, an eye formed transversely in said head, a wooden handle in said eye, a wedge driven into the end of said handle, said wedge comprising:

a plurality of U-shaped elements, each said element tapering in thickness from the upper end to the lower end of said element, each said element having free edges tapering from the upper end to the lower end of said element, said plurality of elements being integrally formed in end-to-end relation to provide a U-shaped wedge having stepped tapered major surfaces and stepped tapered edge surfaces.

* * * * *